United States Patent [19]

Koleda

[11] 3,937,481

[45] Feb. 10, 1976

[54] SKI CONSTRUCTION

[76] Inventor: Michael T. Koleda, 15 Murray Ave., Port Washington, L.I., N.Y. 11050

[22] Filed: Nov. 27, 1974

[21] Appl. No.: 527,584

[52] U.S. Cl. ..... 280/11.35 C; 280/11.13 W

[51] Int. Cl.[2] ..... A63C 9/08

[58] Field of Search... 280/11.35 A, 11.35 D, 11.35 C, 280/11.35 T, 11.35 E, 11.13 W

[56] References Cited

UNITED STATES PATENTS

| | | | |
|---|---|---|---|
| 2,614,858 | 10/1952 | Pierce, Jr. | 280/11.35 C |
| 3,198,537 | 8/1965 | Silberman | 280/11.35 C |
| 3,620,545 | 11/1971 | Korger et al. | 280/11.35 T |
| 3,733,082 | 5/1973 | Murata | 280/11.35 T |
| 3,810,644 | 5/1974 | Beyl | 280/11.35 T |

FOREIGN PATENTS OR APPLICATIONS

| | | | |
|---|---|---|---|
| 1,464,104 | 11/1966 | France | 280/11.35 C |
| 1,195,649 | 6/1965 | Germany | 280/11.35 D |

*Primary Examiner*—M. H. Wood, Jr.
*Assistant Examiner*—David M. Mitchell
*Attorney, Agent, or Firm*—W. Lee Helms

[57] ABSTRACT

A ski construction in which the ski runner slidingly supports an elongated plate, except at its adjustable front end which is fixed in normal use of the ski, the plate carrying toe and heel binding members, the plate being specially mounted to freely follow the runner in its rapid bending movements in use of the ski, and also adapted to alievate the stress and shock imposed on the ankle area of the skier when the front of the ski strikes an obstruction and the ski abruptly stops, as by striking a root obstruction, a body of hard ice hidden by snow, or packed snow, and this aliveation without changing the action of the binding members or their mutual set-spacing on the plate. For the latter function, the front end of the plate carries a row of teeth engaged by a worm carried by a shaft within a casing fixed to the runner, one end of the shaft having means for its manual rotation for adjustment of the plate, and a spring encircling the shaft and having its front end abutting the interior of the casing, so that when the ski is suddenly stopped by an obstruction, the forward strong thrust of the skier's leg moves the entire plate forwardly against the action of said spring, alievating shock on the ankle area.

2 Claims, 8 Drawing Figures

SKI CONSTRUCTION

The objects of the invention are to provide a ski construction which by simple and effective combinations of elements will enable improved adjustments, on the ski runner, by an elongated plate carrying toe and heel binding members, toothed at its front end, the latter in a casing held by the runner, the casing receiving a manually operable shaft carrying a worm engaging said teeth, and the shaft being manually rotatable adjusts the elongated plate forwardly or rearwardly on the runner. The worm abuts a spring in the casing whereby a safety provision is provided by which, should the front end of the ski meet an obstacle, the continused foreward movement of the skier's binding-held ankle will be cushioned by forward movement of the elongated plate controlled by said spring. Said adjustment means is aided by the provision of means held by the runner for holding and guiding the elongated plate and which act without holding pressure on the plate.

The invention will be described with reference to the accompanying drawings, in which.

Figure 1:
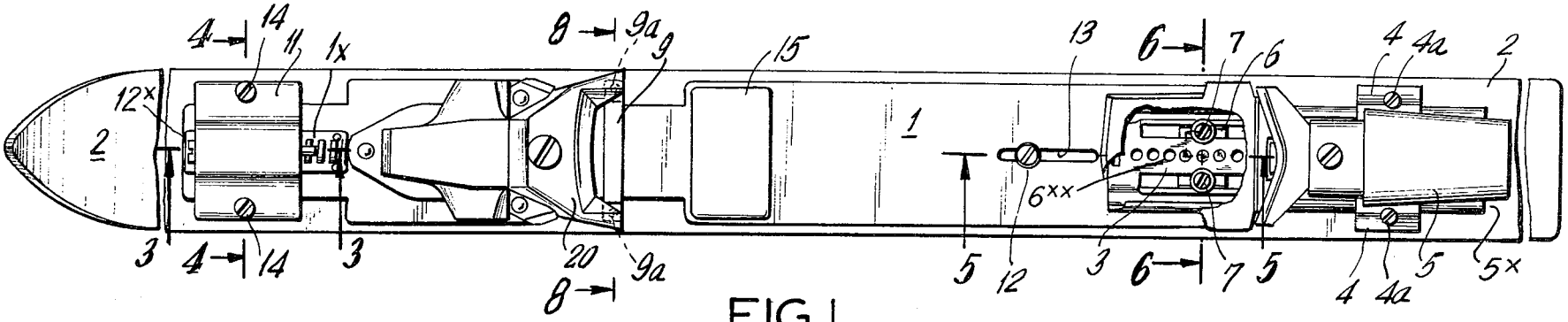
FIG. 1 is a top plan view of a ski construction embodying the invention, its ends being broken away for purpose of illustration.
Figure 5:
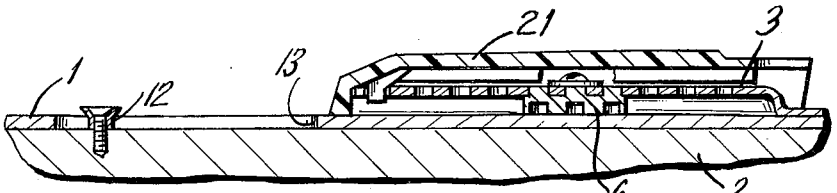
Figure 6:
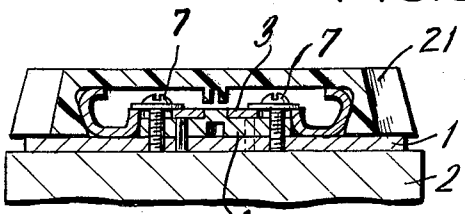
Figure 4:
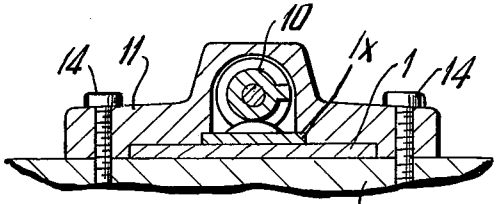

FIG. 4 is a transverse sectional view, taken on the line 4—4, FIG. 1, in comparison with the vertical longitudinal view of the preceding Figure, 3, FIG. 5 is a longitudinal sectional view, taken vertically on the line 5–5 FIG. 1, and FIG. 6 is a transverse section taken on the line 6—6.

Figure 2:
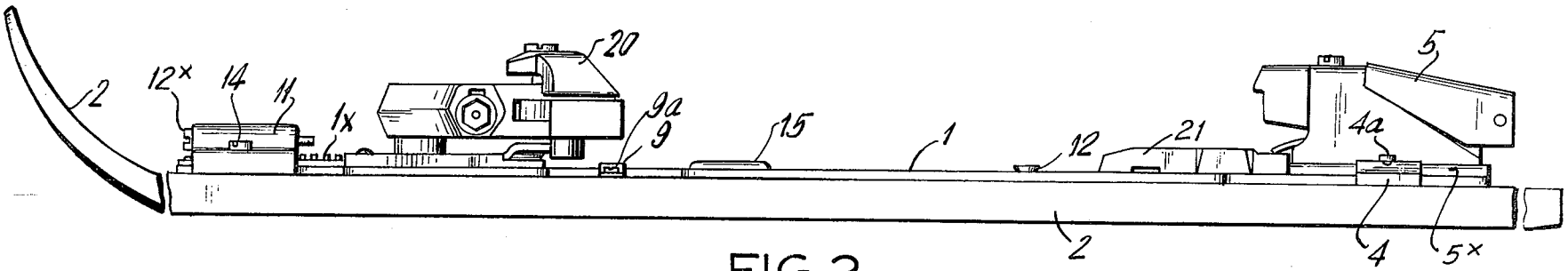
FIG. 2 is an elevational view taken at the side of the structure shown in FIG. 1.
Figure 7:
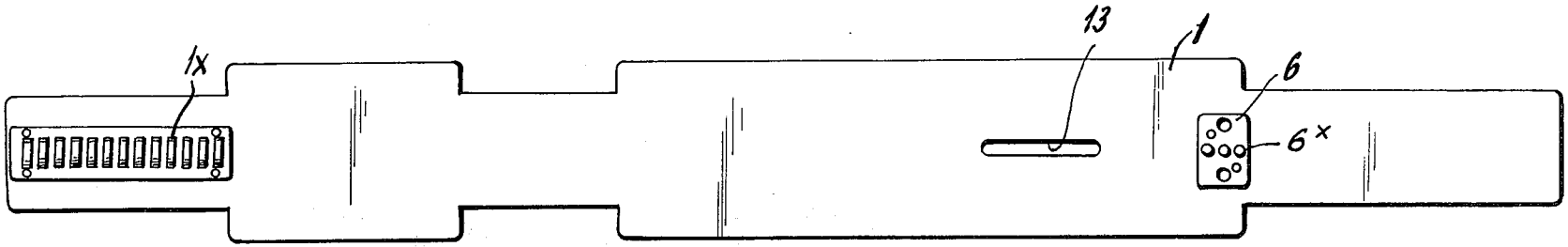

FIG. 7 is a top plan view of the elongated plate 1, which carries the boot heel and toe binding members shown in FIG. 1 and FIG. 2 but which are not shown in said FIG. 7.

Figure 8:
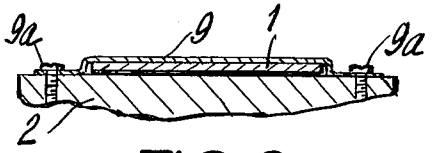

FIG. 8 is a transverse section, broken away at its lower base of a ski runner, taken on the line 8—8, FIG. 1, and showing the strap hold-down for the elongated plate below the toe binder element shown in FIGS. 1 and 2.

Referring to the drawings, it will be seen that the ski construction illustrated comprises a ski runner 2 and which may be of conventional material and form. Supported on the ski runner is an elongated plate 1, and which carries a forward toothed projection, which as hereinafter explained is an element of a longitudinal adjustment assembly for the plate. Slightly at the rear of the toothed projection which is indicated by the designated numeral 1x, is a toe binding member for the boot of a skier, followed by a boot abutment plate 15 for the sole of the boot. Following the latter member 15, is an adjustable boot heel binding member 5 which may be of strong embodiment with a smooth lower surface enabling satisfactory forward and backward adjustment on the elongated plate 1 on which it rests, and normally is held down.

It will be seen by reference to FIGS. 1 and 2, that the heel binding member 5 at its base is formed with narrow lateral abutments $5^x$ which are overhung by strap-like members 4 which abut the sides of elongated plate 1 and which are secured to the ski runner 2 by screws 4a. Thus it is apparent that the rear end of the elongated plate, in the embodiment illustrated, is of the same width as that of the lateral abutments $5^x$ of the heel binding member 5. Forwardly of the said heelbinding member it has an extension 3, and for the purpose of adjustably holding said extension onto the elongated plate 1, said extension is formed with an elongated row of round apertures, as shown in Fig. 1, adapted to receive one or a plurality of studs carried by a member 6 secured to the elongated plate 1, and said extension is springy and can be released from its stud holding condition whereupon the heel binding member 5 can be adjusted forwardly or backwardly to meet the needs of boots of various sizes.

Member 6, fixed to the elongated plate 1, as shown in Fig. 7 is a small plate having three upstanding short studs $6^x$ adapted to enter the round holes $6^{xx}$ of the front extension 3 of the heel binding member. Said extension 3 has opposite longitudinal slots which receive headed screws 7 threaded into elongated plate 1 via small plate 6, and the screw heads (or washers under them) engage the side walls of said slots.

By loosening said screws, said heel binder extension can be slightly raised to clear the studs, it preferably being springy, and positioned forwardly or backwardly. When this adjustment is made, screws 7 will be turned down to hold the heel binding member in its adjusted position on elongated plate 1.

It is desirable that the heel binding member extension be provided with a removable cover, preferably of snap-on form as of plastic material and as shown at 21, FIGS. 5 and 6.

The skier can readily move the space-adjusted heel and toe binding members simultaneously forwardly or rearwardly of the ski runner to a position most favorable with respect to slopes of various steepness, for example, this being done easily by turning the adjusting screw $12^x$, as by a small pocket tool effective as a screw driver.

II

Figure 3:
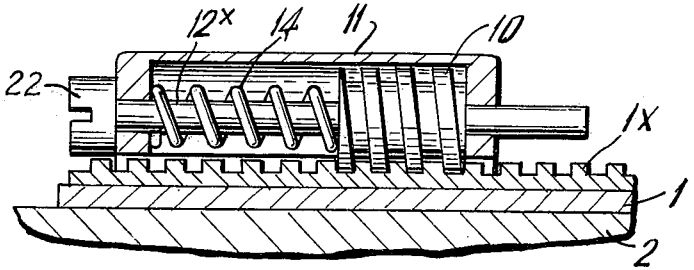
FIG. 3 is a vertical sectional view taken on the lines 3—3, FIG. 1, of the member designated 11 in that Figure, but enlarged for clarity of illustration.

This specification will now describe the forward elements of the ski invention, and particularly with respect to a safety feature which long has been needed, but not found in the various constructions in use prior hereto:

The safety cushioning members of the ski are as follows:

Reffering to FIG. 3 it will be seen that the toothed extension of the elongated plate 1, indicated at $1^x$ is engaged by worm 10, the latter being fixed to a shaft $12^x$ having a head which is slotted, as a screw. Forwardly the "screw"-shaft carries a spiral spring which at its front abuts a wall of a casing 11; and the casing, as shown in FIG. 1, has lateral projections receiving screws entering the runner 2, thereby holding the casing in fixed position. The shaft projects rearwardly of the casing so that it will be held when projected forwardly. When the "screw"-shaft is rotated the worm, being actuated will move elongated plate forwardly or rearwardly in accordance with the direction of rotation, and this can be done by a skier without removing the ski from his boot, and simply by use of a pocket tool having screw-driver action. The function of the said elements, in addition to adjusting the elongated plate on its runner, is as follows:

Many injuries to skiers are caused when a ski in fast movement strikes an obstruction generally hidden or partly hidden by snow or ice, and also when the obstruction is packed snow. In such case the ski has a sudden stop. In such case the force of the skier's momentum, with his boot tightly bound to the ski, throws immediate and usually severe stress on the skier's leg, fractures not being uncommon. By the present invention such quick and severe thrusts upon a skier's leg are cushioned, the thrust upon his toe-binding member overcoming the normal holding of the elongated plate 1 on the runner below it, with the result that plate 1 will be thrown forwardly, its toothed extension forcing the worm against the spring 14, with the required cushioning result.

The elongated plate 1 which carries the boot binding members is provided with elements holding the plate into contact with the upper surface of the ski runner, and guiding it against lateral movement. Thus at the rear of said elongated plate at 13 it is centrally and longitudinally slotted to receive a headed screw 12 FIG. 1 the slot being indicated at 13, FIG. 1. Toward the front of the ski the elongated plate is held down and guided by the strap-like formation of the worm casing 11 fastened down to the ski runner by screws 14 entering the longitudinal projections or "wings" of the casing. Also, the strap-like members 4 which overhang the lateral projections of the heel binding member, as indicated at 4, FIG. 1 and 2 have like function, together with the strap 9 over the marginal edges of the elongated plate and held down to the ski runner by screws 9*a*. By such means the elongated plate is held down against endwise movement in normal use. except in desired adjustment thereof and in the automatic cushioning thrust on the plate as described above, said thrust being excessive.

It will be understood that various modifications in the form and arrangement of the illustrated elements may be made within the spirit of the invention and the claims herein, without departing therefrom. Also an important feature of the invention is that only the front end of the elongated plate is fixed to the runner. Thus the plate follows the rapid bends of the runner in use of the ski. As shown in FIG. 5 the screw 12 entering the slot 13 of the plate 1 is restricted in down movement by a busing 12$^{x}$. So that while it holds down and guides the plate so that the smooth under surface thereof meets the runner, the plate exerts no pressure thereon. Such is the pressure-free action of all the straps overlying the plate back of its worm adjusting combination.

Having described my invention, what I claim and desire to protect by Letters Patent, is as follows:

1. In combination, a ski runner, an elongated plate mounted on the ski runner, and bodily movable thereon, toe and heel boot binding members carried by said elongated plate, means for adjusting one of said boot binding members forwardly or rearwardly on said elongated plate, teeth carried at the front of the elongated plate, a worm engaging said teeth and manually operable means for rotating said worm, whereby said elongated plate may be adjusted forwardly and rearwardly on the ski runner, and comprising a shaft carrying the worm, a casing affixed to the ski runner and in which the shaft and worm are mounted, one end of the shaft being exposed with a head adapted for manual rotation of the shaft and worm, and a spring member within the casing and engaged by the worm and abutting the front wall of the casing, whereby, when the front end of the ski runner abuts an obstruction, the stress and shock imposed on the ankle area of the skier by its continued forward movement when held by the bindings is alievated by cushioned forward movement of the elongated plate, and without changing the distance between the toe and heel members, or releasing their boot holding action.

2. A ski construction in accordance with claim 1 in which the worm carries a screw-like shaft on which the spring is mounted, the casing for said worm being fastened at its sides to the margins of the ski runner, the casing having a rear aperture through which an extension of the screw-like shaft is projected, the front of the shaft being projected through a front aperture of the casing and the head thereof formed with means for its manual rotation, the elongated plate being formed with a longitudinal slot intermediate the binding members, a bushing in said slot, a screw entering the bushing and engaging its top, whereby the screw is restricted against putting pressure on the top of the plate, the plate having a narrowed width at each end and also adjacent the rear of the toe binding member, said casing overlying the forward narrowed end, and two spaced strap members, each lying over one of said narrowed areas of the plate, and having their ends fastened to the ski runner and guiding and holding down said plate in such manner that its smooth under surface meets the ski runner without pressure thereon and enabling the plate to follow rapid bends of the runner when the ski is in use and with consequent sliding movements of the plate rearwardly of its fixed front end area in normal use of the ski.

* * * * *